US008267608B1

(12) United States Patent
Wheeler et al.

(10) Patent No.: US 8,267,608 B1
(45) Date of Patent: Sep. 18, 2012

(54) RAMMING TOOL FOR FILLING SURFACE VOIDS

(76) Inventors: Michael Wheeler, Tofield (CA); Cheryl Wheeler, Tofield (CA)

( * ) Notice: Subject to any disclaimer, the term of this patent is extended or adjusted under 35 U.S.C. 154(b) by 522 days.

(21) Appl. No.: 12/459,527

(22) Filed: Jul. 2, 2009

(51) Int. Cl.
*B43K 5/06* (2006.01)
*B43M 11/06* (2006.01)

(52) U.S. Cl. ..... 401/176; 401/150; 401/261; 401/263

(58) Field of Classification Search ..... 401/261, 401/263, 150, 176
See application file for complete search history.

(56) References Cited

U.S. PATENT DOCUMENTS

| | | | | |
|---|---|---|---|---|
| 2,187,324 | A | 1/1940 | Many | |
| 2,459,296 | A * | 1/1949 | Smith | 401/263 |
| 3,557,563 | A | 1/1971 | Stevens | |
| 4,044,512 | A | 8/1977 | Fischer et al. | |
| 4,074,735 | A | 2/1978 | McCabe et al. | |
| 4,120,128 | A | 10/1978 | Pauls | |
| 4,269,014 | A | 5/1981 | Grammerstorf | |
| 4,352,262 | A | 10/1982 | Edelmann et al. | |
| 4,509,884 | A | 4/1985 | Trout et al. | |
| 4,792,066 | A | 12/1988 | Kobayashi | |
| 4,861,401 | A | 8/1989 | Miura | |
| 5,033,952 | A | 7/1991 | Haug | |
| 5,223,272 | A | 6/1993 | Pringle | |
| 5,257,486 | A | 11/1993 | Holmwall | |
| 5,342,149 | A | 8/1994 | McCabe | |
| 6,364,578 | B1 | 4/2002 | Puvilland | |

* cited by examiner

*Primary Examiner* — David Walczak
*Assistant Examiner* — Bradley Oliver
(74) *Attorney, Agent, or Firm* — Patent Law & Venture Group; Gene Scott

(57) ABSTRACT

A hand tool apparatus for filling voids in a surface includes a cylindrical ram housing having an interior ram space. A ram rod is axially mounted within the ram space. A handle is collinearly engaged with the ram rod and extends outwardly from one end of the ram housing. A hopper positioned on the ram housing is in communication with the ram space within the ram housing. A trowel plate, having a straight edge, is positioned on a further end of the ram housing. The ram rod is guided along the interior of the ram housing by a groove guide, located on the interior of the ram housing, and a groove flange, located on a guide ring that is attached to the ram rod.

5 Claims, 3 Drawing Sheets

RAMMING TOOL FOR FILLING SURFACE VOIDS

BACKGROUND OF THE INVENTION

1. Field of the Present Disclosure

Figure 1:
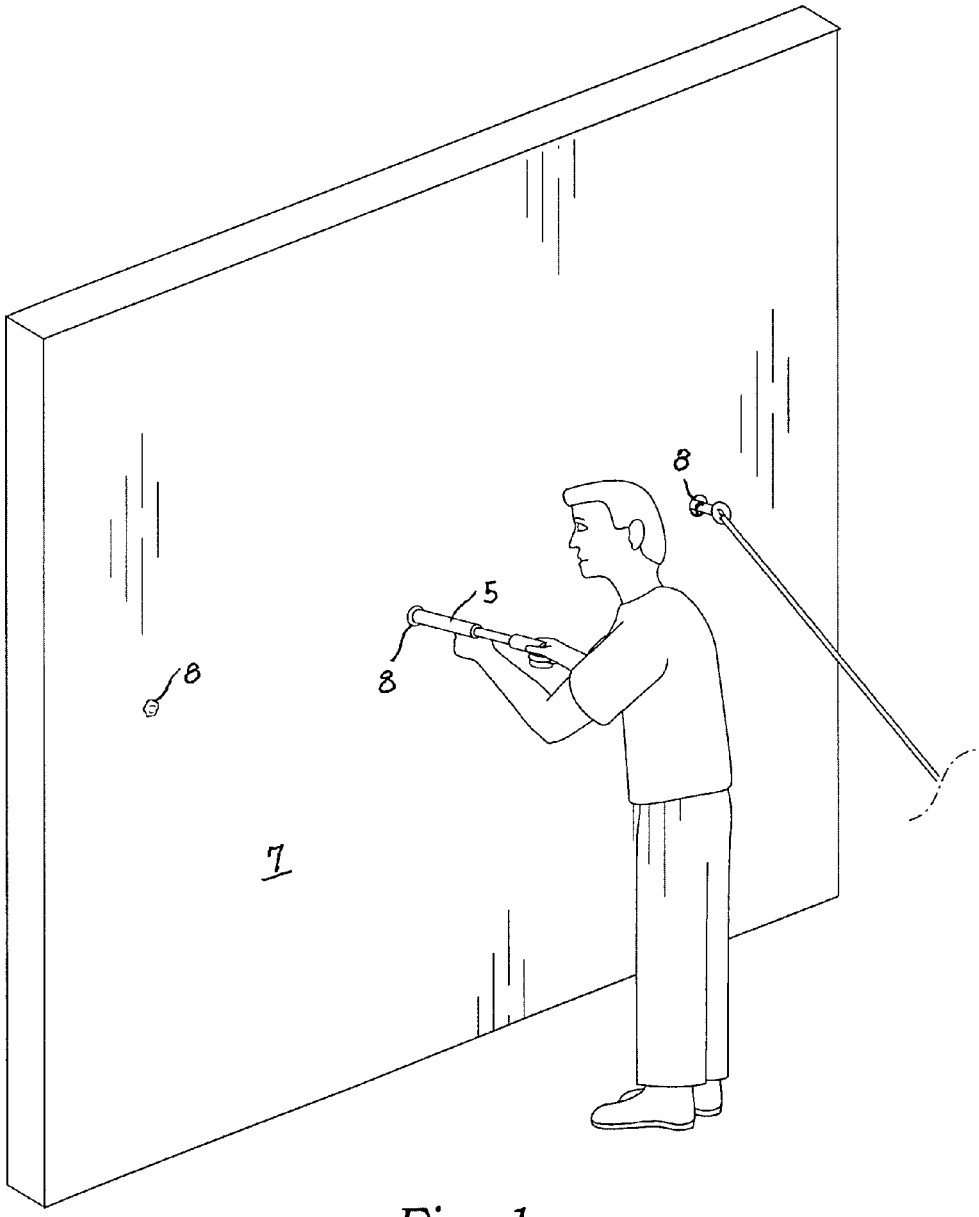

This disclosure relates generally to hand tools and more particularly to a ramming tool for filling surface voids in concrete walls and other structures.

2. Description of Related Art Including Information Disclosed Under 37 CFR 1.97 and 1.98

Puvilland, U.S. Pat. No. 6,364,578 discloses a device for injecting material in the form of a suspension into a void. The device comprises an injection tube for injecting the material, the tube having a coupling first end and a second end that is open; a coupling has a cylindrical portion provided with an axial bore having a coupling first end for coupling to the first end of the tube, and a second end, said coupling further comprising a radial stub for coupling to a feed pipe for feeding material in suspension; a vent hose is engaged in the said tube and in the coupling, the hose having a first end projecting from the second end of the tube and a second end that projects from the second end of the coupling; and a sealing piece for establishing sealing between the second end of the coupling and the outside wall of said hose.

McCabe et al., U.S. Pat. No. 5,342,149 discloses a system that separately furnishes an injector apparatus placed within a pipe, two or more grout components. The injector apparatus is secured in position in the pipe by components of the injector apparatus that are urged into a position of cooperation with a modified section of pipe as a consequence of the increased hydraulic pressure that occurs within the injector apparatus during the pumping of one of the grout components thereinto. The two or more grout components after separately being furnished to the injector apparatus are then combined together by elements of the system and are then thoroughly mixed (reacted) together by other elements of the system to form a grout that is discharged from the system following their mixing together and prior to setting of the grout in ideal proximity with respect to a crack or crevice requiring grout application. All components of the system are recovered for subsequent use elsewhere.

Holmwall, U.S. Pat. No. 5,257,486 discloses a sealant nozzle that includes a positioning spider at its outlet end. Spider is inserted into a mounting hole, or is secured to an outer surface, or is mounted in a corner region of a structure. Spider includes a plurality of radial lugs which bend about flex hinges, enabling the spider to automatically conform to a range of hole sues. In a surface installation, the lugs are glued to the surface. In a corner installation, some of the lugs contact and are glued to intersecting surfaces that define the corner. A sealant is delivered into and through a passageway in the nozzle, to and through an enlarged diameter end void at the outlet of passageway, and then into the crack to be sealed.

Pringle, U.S. Pat. No. 5,223,272 discloses a method of repairing cracks in brick walls by drilling spaced apart injection ports into the crack. Verification ports are drilled generally in alignment with the injection ports on each side of the crack. The wall is saturated with water and grout is injected into the injection ports until a limiting pressure is reached or until grout begins to flow from the verification ports. An apparatus for repairing cracked brick walls includes a grout delivery tube having a nozzle and an expandable sleeve to seal to the tube within injection ports. Valves and a grout circulation loop control the injection of grout from the delivery tube.

Haug, U.S. Pat. No. 5,033,952 discloses an injection adapter for introducing a flowable compound into a drilled hole in masonry has a plastic tubular part having an inner thread in the upper end thereof for engaging a threaded end of a bolt of a fixing element anchored in the drilled hole that threaded end projects from the drilled hole. The injection adapter has a lower tapering end having a front annular end face for engaging an adjacent annular end face of a sleeve of the fixing element.

Miura et al., U.S. Pat. No. 4,861,401, discloses a method of injecting adhesives into cracks of structures for sealing the cracks, involves affixing injection pipes on non-sealed surface portions of the structures at the cracks and connecting an adhesives injection device to each one of the injection pipes. The injection devices are comprised of transparent cylinders having scales thereon graduated toward injection, nozzles thereof, and of pistons that can move linearly in both directions in the cylinders. The nozzles are respectively connected to the injection pipes after adhesives are drawn into the cylinders, and the pistons are moved toward the nozzles by compression, or pushing pressure, of rubber or springs to inject the adhesives into the cracks.

Kobayashi, U.S. Pat. No. 4,792,066 discloses a chemical liquid injector mainly for use in filling with a chemical liquid cracks developed in a wall of a concrete building and a gap between the wall and the underlying concrete body. An air-escape groove is provided in the interior surface of the injector casing. While in use, a mouthpiece is attached to a nozzle of the injector.

Trout et al., U.S. Pat. No. 4,509,884 discloses a nozzle for injecting adhesive materials into cracks in concrete, mortared joints in brick or stone walls, in timber, or in similar materials, the nozzle having a body with a center channel for conducting the resin from a suitable pump into the cracked surface. The nozzle may be surface mounted or mounted in a drilled hole, and has a proximal end adapted for connection to a conventional coupling and a distal end surrounded by spaced lugs which facilitate insertion of the distal end into a hole and aid in retaining the nozzle therein. The spacing between the lugs and a plurality of grooves in the distal end communicating with the center channel minimize backpressure when surface mounted and resist backpressure when mounted in a hole, and provide an even diffusion of the resin into the void. A collar is normally provided near the distal end for partially or completely sealing the installation and for retaining an adhesive gel or putty cone that further seals the installation. The collar may also serve as an abutment against which a suitable driver can be placed to drive the nozzle into a hole.

Edelmann et al., U.S. Pat. No. 4,352,262 discloses a method of repairing cracks in a concrete structure to prevent leakage wherein rods are inserted in the crack at spaced intervals to extend outwardly therefrom. A surface seal is applied to extend partially into the crack near the structure outer surface from which the rods extend, and to the structure outer surface adjacent to the crack and around the rods so that the surface seal acts as a surface barrier for the filler to be injected. Port members, having hollow shaft portions, and a flange portion are placed over the rods with the flange portions approximately adjacent the structure outer surface. Substantially the entire flange portion is embedded in the surface seal. The surface seal is allowed to cure to define a surface barrier for the filler, and the rods are removed from the crack and port members such that the ports communicate with the crack void behind the surface seal. After the surface seal cures, a filler is injected through the port members and into the crack void, and the port members are plugged. A port and plug assembly for use in sealing the cracks has a hollow shaft portion and a flange portion at one end thereof. The flange defines the base of the port member and is generally flat with the shaft extending from only one side of the base, the base being adapted to be embedded in a surface seal in the crack sealing method.

Grammerstorf, U.S. Pat. No. 4,269,014 discloses a device that fastens and retains a bonding and sealing device in a drilled hole in construction parts or in buildings by forcing injection material, such as synthetic resins into cracks and flaws present on the construction parts or on the building component. A sealing bushing encases a portion of a sleeve. The sleeve is expanded from its inside thereby sealingly clamping the sealing bushing between the walls of the drilled hole and the encased portion of the sleeve.

Pauls, U.S. Pat. No. 4,120,128 discloses a tubular anchoring member having an interior passage is inserted into an anchoring hole of a support structure. The anchoring member has transverse dimensions smaller than those of the anchoring hole so that a clearance is defined therewith. A ring-shaped cap member surrounds the anchoring member at a trailing end thereof, supports the anchoring member, and closes the open end of the clearance. An aperture formed in the anchoring member communicates the interior passage with the clearance. A guide sleeve is inserted into the interior passage until a closed leading end of the sleeve is located in the vicinity of the aperture. An open trailing end of the sleeve is connected to a collapsible envelope that is subdivided into a plurality of compartments, each containing a different component of a multi-component hardenable binder material. The compartments are brought into communication with each other and, in response to collapsing the envelope; the respective components are intermixed and advanced from the collapsible element through the interior of the guide sleeve to be introduced into the clearance via the aperture. The closed leading end of the guide sleeve is opened by either cutting off such leading end from the remainder of the sleeve or by bursting in response to forces generated during the collapse of the envelope. The intermixed components introduced in the clearance harden therein about the anchoring member and thereby anchor the latter in the anchoring hole.

McCabe et al., U.S. Pat. No. 4,074,735 discloses a grouting tube for packer designed to prevent back-flow of cement grouting material past the grout packer out of the grouting area. The grouting tube is comprised essentially of an inner-tube constructed of steel or like material through which the grouting material is designed to flow. The inner tube has threaded nut means disposed a distance from the upper end of the tube on reverse threads. At the other or lower end of the tube, a retaining ring means is disposed and attached to said bottom end by means of rivets or the like. Concentric with said inner tube and disposed between said ring and said nut means is a series of alternating frusto-conical tubes and flexible frusto-conical leather caps. The caps are designed to act as seals between the grouting tube and the walls of the grout hole to prevent backflow of grouting material. A third concentric tube is disposed about the series of leather caps and frusto-conical tubes to protect the caps and tubes during insertion of the grouting tube into the grout hole. Once in the hole, the external third tube is blown away by water, air, or other means, so that the leather caps can provide the sealing means with the grout hole.

Fischer et al., U.S. Pat. No. 4,044,512 discloses a method and arrangement for anchoring an object to a support structure having an anchoring hole. The method includes the process of inserting into the anchoring hole an anchoring member slightly smaller than the latter so that a clearance is formed in the anchoring hole about the exterior of the anchoring member, mounting a cap member in the anchoring hole and about an anchoring member so as to fix the latter in position in the anchoring hole, providing a flow-through passage which is in communication with the clearance on at least one of the cap and/or anchoring members, and injecting a hardenable substance through the flow-through passage and from there into the clearance so that the substance forms a plug about the anchoring member and fixes the same in the anchoring hole upon hardening.

Stevens, U.S. Pat. No. 3,557,563 discloses a device for attachment to a grouting nozzle, the device including a tube frictionally connected to a sealing sleeve member. A plug is slideably mounted in the tube and normally retained in spaced relation from the sleeve member to permit the flow of grouting material through the tube to fill a void at the outward end thereof. When such void is filled, the plug is displaced to a second sealing position with respect to the sleeve member for sealing position with respect to the sleeve member for effecting a seal against backflow of grouting material.

Many, U.S. Pat. No. 2,187,324 discloses a devise comprising a fluid material conveying tube, a deflecting element attached to one end of the tube in spaced relation therewith, said deflecting element having a concaved face axially aligned with the tube for all directions of the tube and reversely of its movement therethrough.

The related art described above discloses the use of a variety of ramming tools for filling surface voids in concrete walls and other structures. However, the prior art fails to disclose a hand-held ramming tool for filling surface voids in concrete walls and other structures, where the tool is equipped with a hopper, for easily funneling material into the tool, and provides a built-in trowel, for creating a smooth edge once material injection is complete. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The presently described and claimed apparatus is a hand tool for filling voids in a surface. The hand tool comprises a cylindrical ram housing having an interior ram space and a ram rod that is axially mounted within the ram space. A handle is collinearly engaged with the ram rod and extends outwardly from one end of the ram housing. A hopper positioned on the ram housing is in communication with the ram space within the ram housing. A trowel plate, having a straight edge, is positioned on a further end of the ram housing. The ram rod is guided along the interior of the ram housing by a groove guide, located on the interior of the ram housing, and a groove flange, located on a guide ring that is attached to the ram rod.

A primary objective inherent in the above described apparatus and method of use is to provide advantages not taught by the prior art.

Another objective is to provide a hand tool for filling voids in surfaces such as concrete or brick.

A further objective is to provide a convenient means of supplying such a hand tool with a material filler.

A still further objective is to provide a convenient means of creating a smooth surface after material filler is applied to a surface void.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Figure 2:
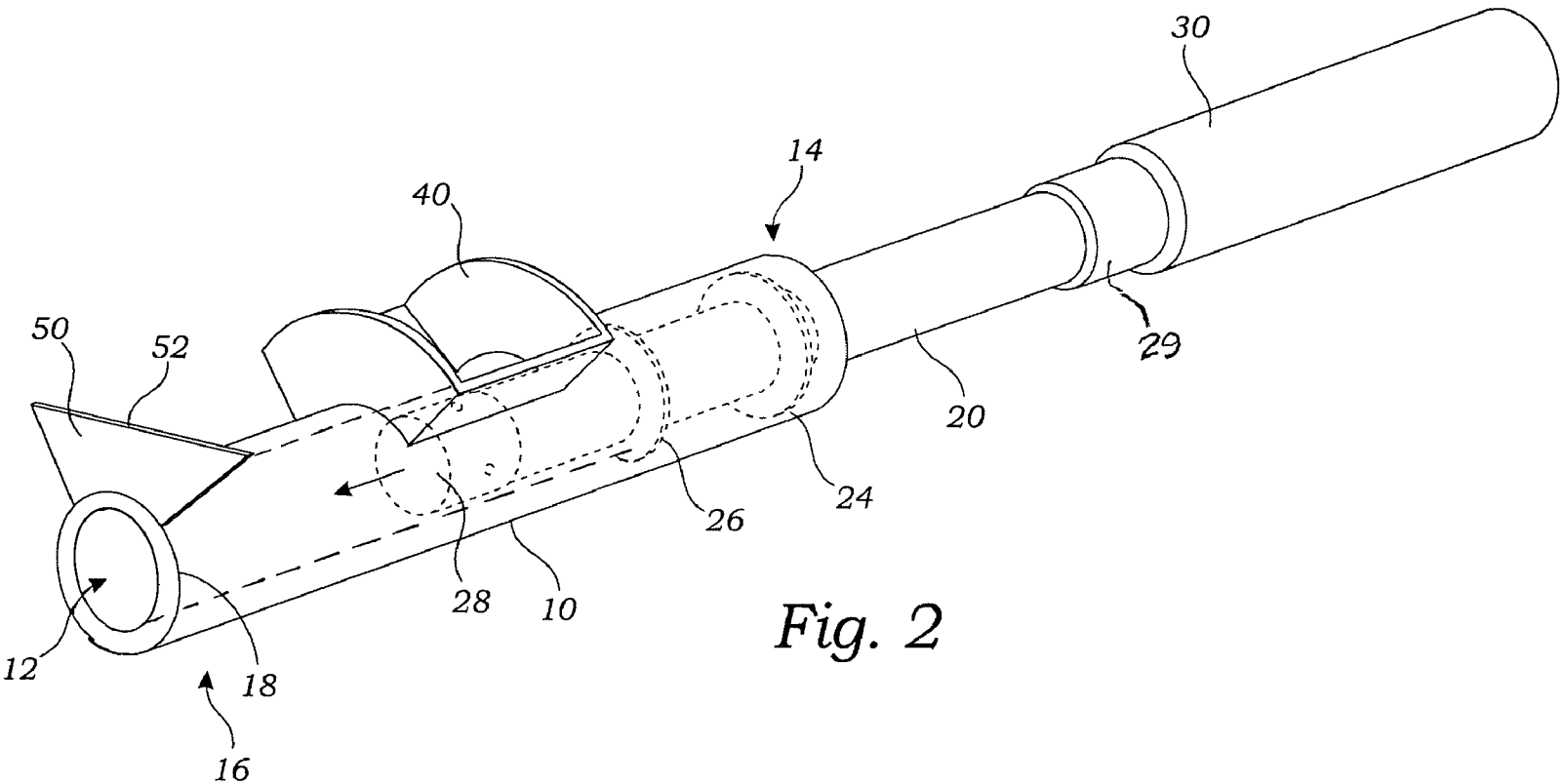
Figure 3:
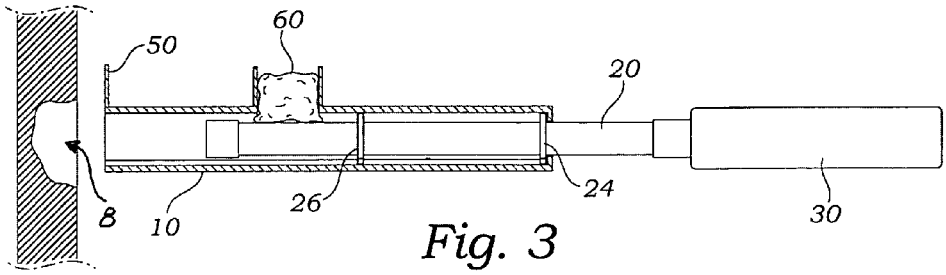
Figure 4:
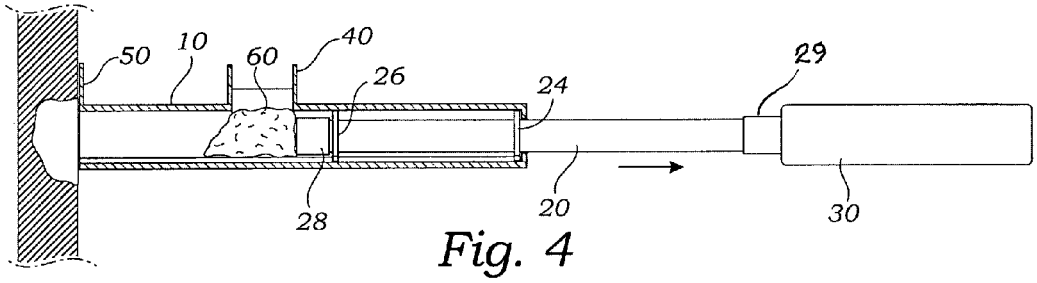
Figure 5:
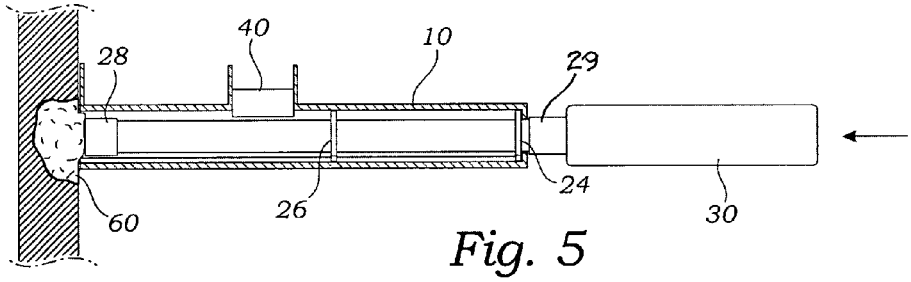
Figure 6:
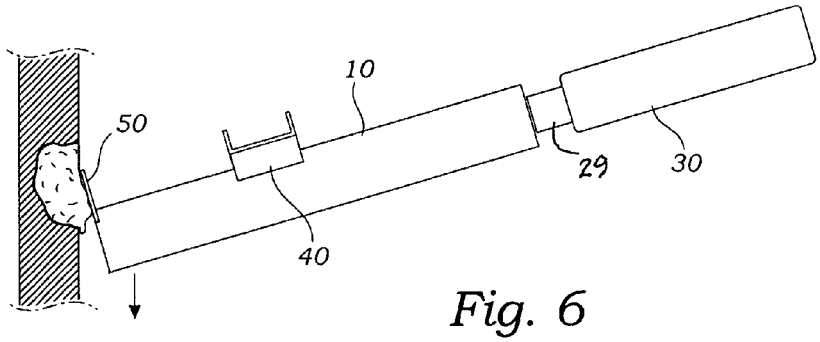

Illustrated in the accompanying drawing(s) is at least one of the best mode embodiments of the present invention In such drawing(s):

FIG. 1 is a perspective view of the apparatus in use filling a void on the surface of a wall;

FIG. 2 is a perspective view of the apparatus showing interior elements with dashed lines; and FIGS. 3-6 are side views taken as vertical sections showing in FIG. 3, the loading of filler material into a hopper of the apparatus; in FIG. 4, withdrawal of a ram rod to allow the material to fall into a ram chamber; in FIG. 5, ramming the material into a void in a wall; and in FIG. 6, using the built-in trowel to create a smooth outer surface of the filler material.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Described now in detail is a hand tool apparatus 5 that is useful for filling voids and depressions 8 in a wall, floor, or ceiling surface 7 as shown in FIG. 1. As shown in FIG. 2, the apparatus 5 has a cylindrical ram housing 10 providing an interior ram space 12. A ram rod 20 is axially mounted within the ram space 12 and linearly slidable therein as supported by washers 24 and 26 which are fixed in place within housing 10 and within which rod 20 is free to slide. A handle 30 is collinearly engaged with rod 20 and extends rearwardly. A hopper 40 is positioned on top of housing 10 and is in communication with ram space 12. A distal end 16 of housing 10 terminates at annular lip 18, wherein access to space 12 is provided through lip 18. A trowel plate 50 is mounted on housing 10 at lip 18. Plate 50 extends laterally away from housing 10, preferably in alignment with hopper 40, i.e., hopper 40 and the plate 50 are circumferentially aligned and positioned on top of housing 10. Plate 50 provides a terminal straight edge 52.

Referring now to FIGS. 3-6, we see that rod 20 provides a frontal ram 28 which has a slightly larger outer diameter then the major portion of rod 20 and the outer diameter of ram 28 is a tight sliding fit within housing 10. Axial movement of rod 20 within housing 10 enables the ram 28 to move between a rearward position proximal to hopper 40 as shown in FIG. 4, and a forward position shown in FIG. 5, wherein ram 28 is aligned with lip 18. These two positions are terminal ends of travel of rod 20 in that ram 28 prevents further rearward movement of rod 20 when it abuts washer 26 as shown in FIG. 4, and a larger diameter proximal portion 29 of rod 20 prevents further forward movement of rod 20 as shown in FIG. 5.

In operation, the handle 30 is used to first draw rod 20 rearwardly within housing 10 as shown in FIG. 4, so that it clears hopper 40, and then once a filler material 60 is loaded through hopper 40, as in FIG. 3, and then allowed to fall, or is pressed, into the ram space 12, as in FIG. 4, the ram rod 20 is pressed forwardly within the ram space 12 thereby pushing the filler material 60 forward and out of housing 10 so as to fill a depression 8 as shown in FIG. 5. The straight edge 52 of the trowel plate 50 is then pressed against surface 7 and the apparatus is angled with rearward end up, and edge 52 is swept downwardly along the surface 7 over the depression 8 to create a smooth outer surface on the filler material 60, a surface that is coplanar with surface 7. The filler material may be any semi-solid material with a plastic consistency, as for instance, the well known cement filler material known as Drypack®.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A hand tool apparatus for filling voids in a surface, the apparatus consisting of:

a cylindrical ram housing having an interior ram space;

a ram rod axially mounted within the ram space and linearly slidable therein, the ram rod supported by a pair of washers fixed within the interior ram space and within which the ram rod is free to slide, one of the washers fixed at a rear end of the ram space and another of the washers fixed adjacent to the a hopper and between the hopper and the rear end of the ram space;

a handle co-axially engaged with the ram rod and extending rearwardly from the ram housing;

the hopper positioned on the ram housing, the hopper in communication with the ram space within the ram housing; and a forward end of the ram housing providing a terminal annular lip, and a trowel plate mounted on the ram housing adjacent to the annular lip and extending laterally away from the ram housing.

2. The apparatus of claim 1 wherein the trowel plate is axially aligned with the hopper and spaced apart therefrom.

3. The apparatus of claim 1 wherein the trowel plate provides a terminal straight edge.

4. The apparatus of claim 1 wherein the ram rod is axially movable within the ram space between a position rearward of the hopper, and a position forward of the hopper positioning a ramming surface of the ram rod in alignment with the annular lip, whereby a semi-solid material within the ram space may be ejected from the ram housing.

5. A method for filling surface voids in a surface, the method consisting of:

a) loading a filler material into a hopper that is positioned on a cylindrical ram housing;

b) positioning a ram on a pair of spaced apart washers and drawing the ram rearwardly in the ram housing;

c) moving the filler material into a ram chamber in the ram housing;

d) positioning an annular lip of the ram housing in proximity to a surface void to be filled;

e) driving the ram forward in the ram housing to thereby eject the filler material from the ram housing and into the surface void; and f) smoothing the filler material with a trowel mounted on the ram housing to thereby form a surface of the filler material co-planar with the surface.

* * * * *